United States Patent [19]

Moroz et al.

[11] 4,326,756

[45] Apr. 27, 1982

[54] REST FOR DRILLING RIG

[76] Inventors: Viktor M. Moroz, ulitsa Kommunarov, 6, kv. 6; Nikolai Y. Lezin, prospekt Kosmonavtov, 52, kv. 27; Tengiz A. Pavlov, ulitsa Budapeshtskaya 91, korpus 1, kv. 80; Vladimir V. Ilmensky, Vitebsky prospekt, 41, korpus 2, kv. 117, all of Leningrad, U.S.S.R.

[21] Appl. No.: 130,268

[22] Filed: Mar. 14, 1980

[51] Int. Cl.[3] ..... F16C 29/02

[52] U.S. Cl. ..... 308/3.9; 175/220

[58] Field of Search ..... 308/3.9, 3 R, 4 R, 3 A; 175/220

[56] References Cited

U.S. PATENT DOCUMENTS

| | | | |
|---|---|---|---|
| 2,108,035 | 2/1938 | Fuehrer et al. | 308/3.9 |
| 2,365,687 | 12/1944 | Curtis | 308/3.9 |
| 2,394,806 | 2/1946 | Rice | 308/3.9 |
| 3,730,285 | 5/1973 | Anderson | 175/220 |

*Primary Examiner*—Lenard A. Footland

*Attorney, Agent, or Firm*—Lilling & Greenspan

[57] ABSTRACT

The rest comprises a housing accommodating a device for centering a drill rod connected with a rotating mechanism actuated by a hydraulic drive. The characteristic feature of the rest is that the drill rod centering device has at least three link gears with bearing rollers. The rollers are uniformly circumferentially spaced within the housing and each is mounted on a vertical spindle for radial displacement by the drive by means of the rotating mechanism and the link gears. The rollers have their external side surfaces permanently urged against the drill rod to define the centering diameter. The centering device is also provided with hydraulic valves underlying the rollers. The rollers are spring-urged along their axes and are mounted for axial displacement so that, upon a certain friction value developing between the rod and the rollers, the rollers travel jointly with the rod in the direction of drill to engage the hydraulic valves, so that the hydraulic valves are operated to set the centering diameter in correspondence with the rod diameter.

1 Claim, 6 Drawing Figures

REST FOR DRILLING RIG

FIELD OF THE INVENTION

The present invention relates to drilling rigs, and, more particularly, it relates to rests designed for centering the drill string throughout the drilling operation.

DESCRIPTION OF THE PRIOR ART

Known in the art are rests which include jigs for centering the drill string, made in the form of sleeves fixed to the mast of the rig.

In some cases, these sleeves are mounted in antifriction bearings to reduce the friction wear and withstand the impact loads.

A disadvantage of the above rests in their permanent centering diameter.

There is also known a rest structure, considered as the prior art of the present invention, mounted on a cross-piece slidable along the mast and including two hollow half-cylinders engaging each other to define a closed cylindrical space directing a drill rod in the course of drilling. One of the two half-cylinders is fixed to the crosspiece, while the other half-cylinder is mounted on the end of an arm attached to the same crosspiece to be retractable by a hydraulic cylinder, to provide access to the drilling axis, so that a successive drill rod can be either installed or removed, whereafter the half-cylinder can be returned to its initial position.

A disadvantage of this known rest structure is likewise its permanent centering diameter.

In most cases in the process of drilling the drill rods, which are thick-wall pipes, become tapered in the drilling direction on account of the abrasion wear.

Consequently, the clearance between the centering diameter of the rest and the rod at any given amount of operation of the rig is a variable value and may acquire a considerable magnitude, particularly, at earlier stages of the drilling cycle.

As a result, there appears an eventuality that in the drilling operation, particularly in case of inclined drilling, the drill string might become deflected from the required geometric axes of drilling, which, in turn, might cause relatively great bending strain in the drill string bearing assembly leading to a breakdown.

SUMMARY OF THE INVENTION

It is an object of the present invention to provide a drilling rig which, notwithstanding the degree of the dimensional wear of the drill rod, should automatically set the centering diameter corresponding to the actual rod diameter.

This and other objects are attained by a rest for a drilling rig, mounted on the mast or derrick of the rig, comprising a housing accommodating a device for centering a drill rod, connected with a hydraulically driven rotation mechanism. In accordance with the invention, the drill rod centering device includes at least three link gears with bearing rollers uniformly circumferentially spaced within the housing, the rollers being mounted on vertical spindles for radial displacement by a hydraulic drive by means of the rotation mechanism and link gears and having their peripheral side surfaces cooperating with a drill rod, defining the centering diameter. The device also includes hydraulic control valves underlying the rollers, the rollers being spring-mounted along their axes and mounted for axial displacement, so that upon a preset value of friction developing between the rollers and the rod, the rollers are able to move jointly with the rod in the direction of drill and to engage the hydraulic valves, so that the hydraulic valves set the centering diameter to correspond to the rod diameter.

The present invention provides a rest structure wherein the constant clearance between the centering surface of the rest and a drill rod is set automatically, notwithstanding the actual degree of the dimensional wear of the rod.

BRIEF DESCRIPTION OF THE DRAWINGS

The present invention will be further described in connection with an embodiment thereof, with reference being made to the accompanying drawings, wherein.

DETAILED DESCRIPTION OF THE INVENTION

Figure 1:
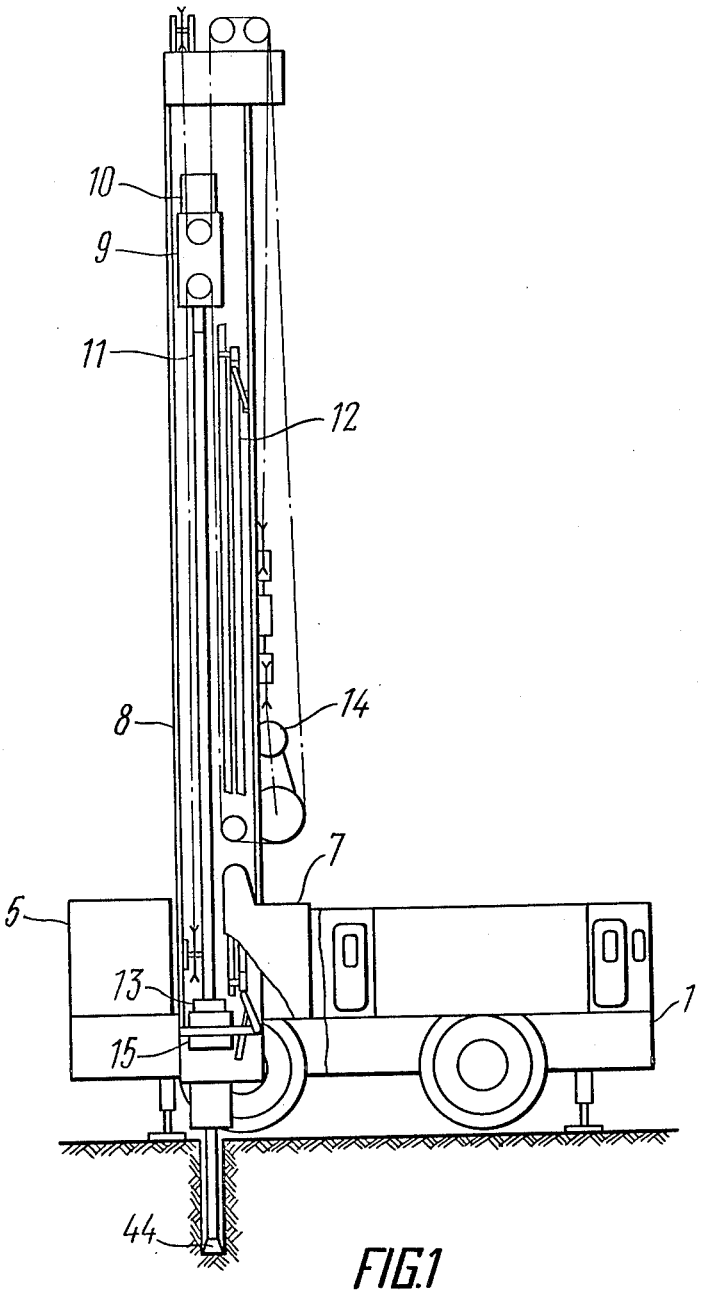
FIG. 1 is an elevational view of a drilling rig incorporating a rest in accordance with the invention.
Figure 2:
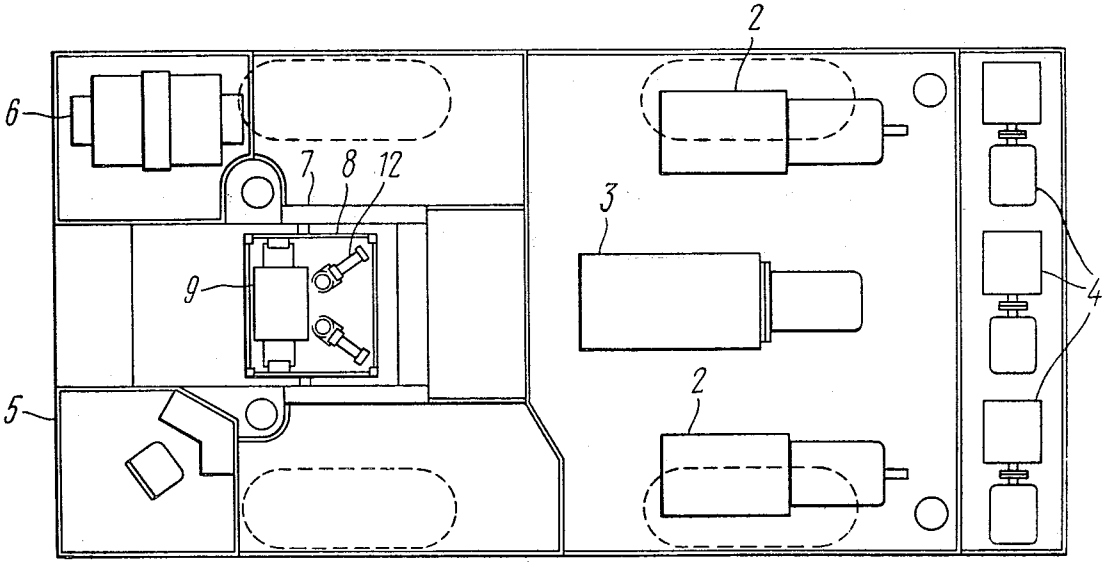
FIG. 2 is a top plan view of the drilling rig of FIG. 1.

Referring now to the drawings, FIGS. 1 and 2, the drilling rig is provided with a self-propelled undercarriage 1 supporting two compressor units 2, a diesel-generator unit 3, three oil pump units 4, the drilling operator cab 5, a transformer 6, a support 7 having the mast or derrick 8 pivotably secured thereto as well as other auxiliary equipment and the necessary control and monitoring gear (not shown).

The mast 8 has mounted thereon a drill string rotating gear 9 with a hydraulic motor 10, a drill rod 11, an arrangement 12 for storing drill rods and feeding them to the drilling line, a rod screw off mechanism 13, an arrangement 14 for running in and out the drill string, and a rest structure 15.

Figure 3:
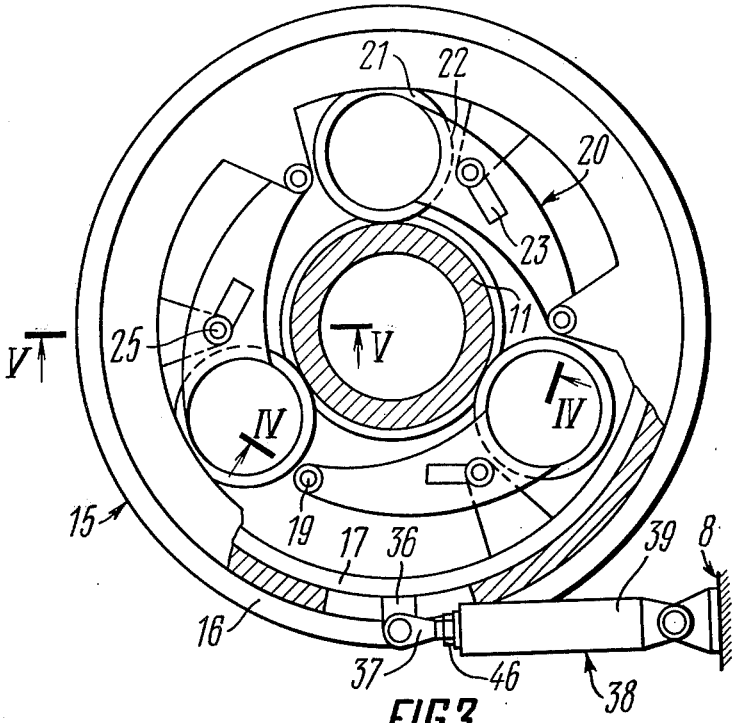
FIG. 3 is a top plan view of the rest in accordance with the invention.
Figure 4:
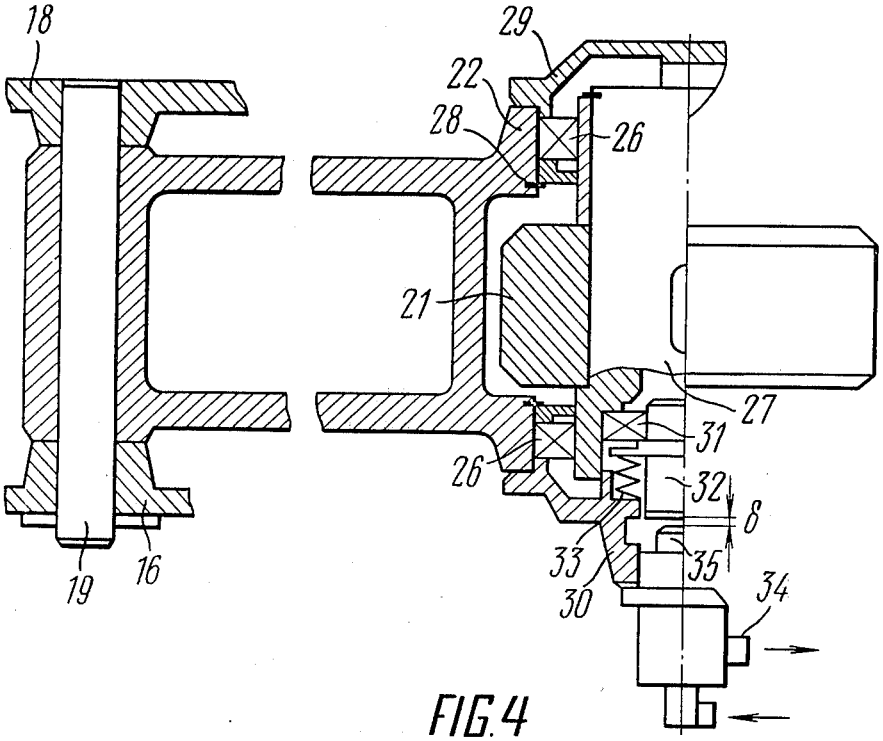
FIG. 4 is a sectional view taken along line IV—IV of FIG. 3.
Figure 5:
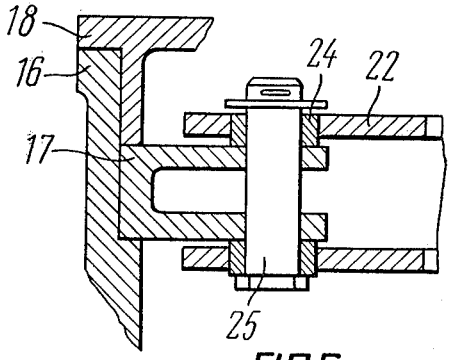
FIG. 5 is a sectional view taken along line V—V of FIG. 5.
Figure 6:
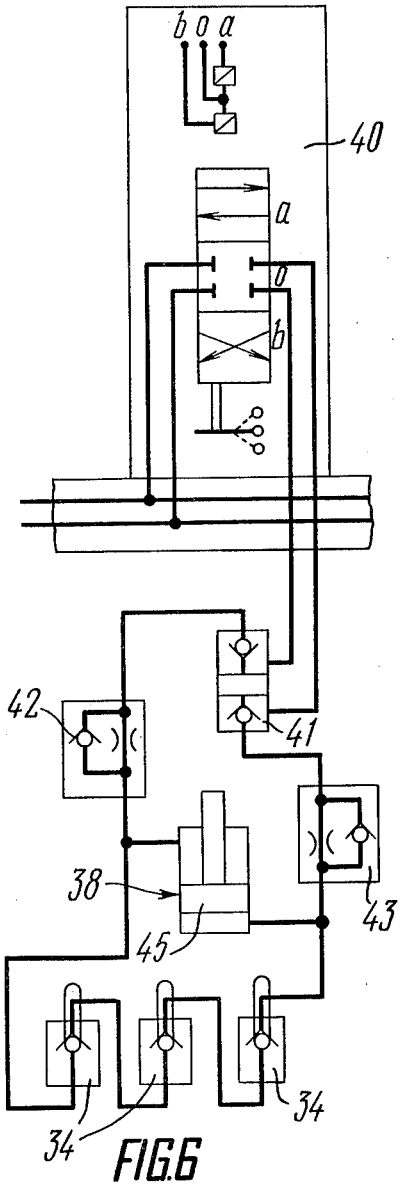
FIG. 6 is a hydraulic circuit diagram of the rest structure.

This rest 15 is shown in more detail in FIGS. 3 to 5 and comprises a cup-shaped housing 16 with a central opening for the passage of the drill rod 11 through the bottom thereof, the housing 16 being fixed to a lower portion of the mast 8.

The internal cylindrical space of the housing 16 accommodates a rotation mechanism with an annular driver 17 retained against axial displacement by a flange 18.

Mounted between the bottom of the housing 16 and the flange 18 are three axles 19 uniformly circumferentially spaced in the housing and serving as the pivot axes of the respective link gears 20.

The link gear 20 includes a bearing roller 21, a fork-shaped arm 22 with a slot 23 slidably receiving a slide block 24 carrying a pin 25 fixed in the respective lug of the driver 17. One end of the arm 22 has a bore receiving the respective axle 19, while its other end has two coaxial cylindrical bores receiving therein roller bearings 26 in which a spindle 27 carrying the respective bearing roller 21 is journalled. The spindle 27 with the bearing roller 21 is mounted for limited axial displacement, while the roller bearings 26 are fixed with lock rings 28 and covers 29 and 30, respectively. An internal bore of the spindle 27 receives therein a ball bearing 31 in which a pintle 32 is journalled.

A socket provided in the cover 30 receives a stack of disc springs 33 urging the spindle 27 towards the opposite cover 29 through the pintle 32 and the ball bearing 31. Threadedly secured in the central threaded bore of the cover 30 is a hydraulic control valve 34 adjusted so that its actuating stem 35 should be normally separated from the adjacent end face of the pintle 32 by a design gap "δ". The driver 17 is pivotally connected by means of a fork 36 with the piston rod 37 of a hydraulic cylinder 38 of which the body 39 is likewise pivotally connected with the mast 8.

Three link gears 20 with their respective bearing rollers 21, accommodated circumferentially within the housing 16, and the single driver 17 define a closed encompassing system through which the drill rod 11 passes and is supported on the rollers 21.

The hydraulic circuitry of the herein disclosed rest structure includes the three positively-actuated check valves 34, the hydraulic cylinder 38, a distributor 40, a hydraulic lock 41 and two throttles 42 and 43. The circuitry is supplied with oil under pressure from the central oil pump unit 4 of the rig.

The rest operates, as follows. When the hydraulic motor 10 of the drill rod rotation mechanism 9 is energized, the drill rod 11 is rotated jointly with the drilling tool 44 fixed to its lower end. Simultaneously, the working hydraulic fluid (or oil) is fed under pressure into the hydraulic system of the rest structure 15. The working fluid is supplied through the distributor 40 set to the position "b", the hydraulic lock 41 and the throttle 42 into the rod-including space of the hydraulic cylinder 38; and, the above-piston space of the hydraulic cylinder 38 is connected to drain via the throttle 43, the hydraulic lock 41 and the distributor 40. The piston 45 with its piston rod is pulled into the cylinder 38, whereby the driver 17 of the link gears 20 is rotated, and the bearing rollers 21 are urged against the drill rod 11, setting the drill rod 11 to the drilling line or axis.

In operation, on account of the non-uniform lengthwise abrasion wear, the drill rod acquires a noticeably tapering shape, whereby the operation of the herein disclosed rest structure with a new, unbraded drill rod of a permanent diameter differs from operation with a dimensionally worn and, therefore, tapering rod.

When operating with a tapering rod, the bearing rollers 21 acting upon by the hydraulic cylinder 38 permanently engaged the rod 11 and hold it strictly at the drilling axis.

Owing to the axial feed of the drill rod and the friction between the rod 11 and the bearing rollers 21, the bearing rollers 21 are pulled down by the rod in the direction of the rod's axial travel, whereby the stack of springs 33 is compressed until the friction is compensated for by the effort of their compression. The design gap "δ" between the pintle 32 and the stem 35 of each respective hydraulic valve 34 is thus taken up, but the valves remain closed. As the drill rod 11 is driven further into the ground, with the drill rod 11 being encompassed by the bearing rollers 21, the diameter of the tapering rod gradually increases, building up the friction between the rod and the bearing rollers, whereby the stacks of springs 33 are compressed still further, until the pintles 32 actuate the valves 34 into their open position.

With all the three hydraulic valves 34 opening, the hydraulic line opens to pass the working fluid under pressure into both the under-piston and above-piston spaces of the hydraulic cylinder 38, and since the effective area of the piston in the above-piston space is in excess of that in the under-piston space, the piston rod is driven outwardly to increase the centering diameter of the rest.

With the centering diameter defined by the setting of the bearing rollers 21 increasing, the friction between the rod 11 and the peripheral side surface of each bearing roller 21 decreases, whereby the stacks of springs 33 lift off the bearing rollers 21 until a moment comes when one of the three hydraulic control valves 34 closes. This is sufficient for the piston of the hydraulic cylinder 38 to be reversed, which means that the bearing rollers 21 are once again urged against the rod 11.

The abovedescribed sequence is periodically repeated until a certain drilling depth is attained, and the centering of the drill rod is no longer necessary; consequently, the distributor 40 is set to the position "a" whereby the working fluid is supplied into the above-piston space of the hydraulic cylinder 38, and the piston rod 37 is driven outwardly to rotate the driver 17 and spread out the link gears 20 with their bearing rollers 21, so that the centering function is discontinued.

Should the efforts be developed which would be capable of driving down solely either one or two of the rollers 21, e.g. as is often the case with inclined drilling, either one or two hydraulic valves 34 open, respectively, which is insufficient to increase the centering diameter of the rest structure. Thus, only three efforts simultaneously acting upon three bearing rollers are capable of increasing the centering diameter of the rest. In any other case the rest maintains the preset position of the bearing rollers 21 and affords an unyielding centering function.

A clearance between the rod of the minimum diameter and the bearing rollers can be preset by adjusting the abutment collar 46 on the piston rod 37 of the hydraulic cylinder 38.

What is claimed is:

1. A rest structure for a drilling rig supported on the mast of the rig and comprising: a housing with a central bore provided in the bottom thereof for the passage of a drill rod therethrough, fixed to a lower portion of said mast; a device for centering the drill rod, accommodated in said housing; a rotating mechanism connected with said drill rod centering device; a hydraulic drive means operatively connected with said rotating mechanism; said device for centering the drill rod including: at least three link gears with bearing rollers uniformly circumferentially spaced within said housing, the rollers being mounted on vertical spindles for radial displacement by the action of said hydraulic drive by means of said rotating mechanism and the respective ones of said link gears, and engaging the drill rod by their respective peripheral side surfaces, thus defining the centering diameter, and hydraulic valves underlying said bearing rollers, the bearing rollers being spring-mounted along their respective axes and mounted for axial displacement so that, when the friction between the drill rod and said bearing rollers attains a preselected value, said rollers follow the drill rod travel in the direction of drill and actuate said hydraulic valves, whereby the hydraulic valves exert a force setting the centering diameter to correspond to the drill rod diameter.

* * * * *